US008616845B1

(12) United States Patent
Liang

(10) Patent No.: US 8,616,845 B1
(45) Date of Patent: Dec. 31, 2013

(54) TURBINE BLADE WITH TIP COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 727 days.

(21) Appl. No.: 12/821,564

(22) Filed: Jun. 23, 2010

(51) Int. Cl.
*F01D 5/08* (2006.01)

(52) U.S. Cl.
USPC ..... 416/1; 416/96 R

(58) Field of Classification Search
USPC ..... 416/92, 95, 96 R, 97 R, 1; 415/115
See application file for complete search history.

(56) References Cited

U.S. PATENT DOCUMENTS

| | | | | |
|---|---|---|---|---|
| 4,992,026 | A * | 2/1991 | Ohtomo et al. | 416/97 R |
| 5,624,231 | A * | 4/1997 | Ohtomo et al. | 416/97 R |
| 6,932,571 | B2 * | 8/2005 | Cunha et al. | 416/97 R |
| 7,334,991 | B2 * | 2/2008 | Liang | 416/97 R |
| 7,537,431 | B1 * | 5/2009 | Liang | 416/95 |
| 7,845,908 | B1 * | 12/2010 | Liang | 416/97 R |
| 7,950,903 | B1 * | 5/2011 | Liang | 416/97 R |
| 8,172,507 | B2 * | 5/2012 | Liang | 415/115 |
| 8,267,658 | B1 * | 9/2012 | Liang | 416/97 R |

FOREIGN PATENT DOCUMENTS

| | | | | |
|---|---|---|---|---|
| JP | 61279702 | A * | 12/1986 | F01D 9/02 |
| JP | 2002195003 | A * | 7/2002 | F01D 5/18 |
| JP | 2008051096 | A * | 3/2008 | |

* cited by examiner

*Primary Examiner* — Edward Look
*Assistant Examiner* — Christopher R Legendre
(74) *Attorney, Agent, or Firm* — John Ryznic

(57) ABSTRACT

A turbine rotor blade with a forward flowing serpentine flow cooling circuit in the airfoil and a serpentine flow cooling circuit formed within the blade tip formed in series to provide cooling air flow through the airfoil and then through the blade tip. Cooling air from the airfoil serpentine circuit is bled off to provide cooling of the trailing edge region through T/E exit slots. The tip serpentine cooling circuit includes legs on the pressure and suction side walls with tip edge cooling holes to provide layers of film cooling air for the blade tip rails. A separate cooling air circuit is used in the leading edge region to provide convection cooling, impingement cooling and film cooling for the leading edge region.

14 Claims, 7 Drawing Sheets

TURBINE BLADE WITH TIP COOLING CIRCUIT

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to turbine rotor blade with blade tip cooling.

2. Description of the Related Art Including Information Disclosed Under 37 CFR 1.97 and 1.98

A gas turbine engine, such as a large frame heavy duty industrial gas turbine (IGT) engine, includes a turbine with one or more rows of stator vanes and rotor blades that react with a hot gas stream from a combustor to produce mechanical work. The stator vanes guide the hot gas stream into the adjacent and downstream row of rotor blades. The first stage vanes and blades are exposed to the highest gas stream temperatures and therefore require the most amount of cooling.

The efficiency of the engine can be increased by using a higher turbine inlet temperature. However, increasing the temperature requires better cooling of the airfoils or improved materials that can withstand these higher temperatures. Turbine airfoils (vanes and blades) are cooled using a combination of convection and impingement cooling within the airfoils and film cooling on the external airfoil surfaces.

A prior art turbine rotor blade cooling circuit is shown in FIG. 1 and includes a (1+3) serpentine flow cooling circuit for a first stage turbine rotor blade, the first stage being exposed to the highest gas stream temperatures in the turbine and therefore requires the most cooling. In the FIG. 1 prior art blade, the airfoil leading edge is cooled with a backside impingement cooling in conjunction with a leading edge showerhead arrangement of film cooling holes 11 along with pressure side and suction side gills holes 12. The cooling air for the leading edge region cooling is supplied through a separate radial cooling air supply channel 13 in which the cooling air passes through a row of metering and impingement holes 14 to produce backside impingement cooling of the leading edge region wall. The spent impingement cooling air is collected in the leading edge impingement channel or cavity 15 prior to being discharged through the showerhead film cooling holes and gills holes 12. The airfoil main body is cooled with a triple pass forward flowing (toward the leading edge) serpentine flow cooling circuit with a first leg 21 being the cooling air supply channel, a second leg 22 and a third leg 23 located adjacent to the leading edge cooling supply channel 13 along with pressure side film cooling holes and suction side film cooling holes. A row of trailing edge exit slots or holes discharge cooling air from the first leg out through the trailing edge region. FIG. 2 shows a flow diagram for the FIG. 1 blade cooling circuit and includes the blade tip cooling holes connected to the radial channels 13, 15, 21, 22 and 23 to provide cooling for the blade tip. FIG. 3 shows a cross section side view of the blade cooling circuit of FIG. 1.

For the blade of FIG. 1, the blade tip cooling is accomplished by drilling holes into the upper extremes of the serpentine flow cooling passages from both of the pressure and suction side surfaces near to the blade tip edge and the top surfaces of the squealer cavity. Film cooling holes are formed along the airfoil pressure side and the suction side tip sections. In addition, convection cooling holes formed along the tip rail at an inner portion of the squealer pocket provide for additional cooling for the squealer tip rail. Since the blade tip region is subject to severe secondary flow fields, this requires a large quality of film cooling holes and cooling air flow to provide adequate cooling for the blade tip periphery. FIG. 4 shows the FIG. 1 blade tip section from the pressure side wall with the row of tip periphery film cooling holes with FIG. 5 showing the tip peripheral film cooling holes for the suction side wall.

For the blade cooling circuit of FIG. 1, the last leg of the serpentine flow cooling circuit is predetermined by a ceramic core manufacturing requirement. As a result of the cooling design requirement, when the cooling air is bled off from the cavity for the cooling of both the pressure and suction sidewalls as well as along the blade tip section, the spanwise internal Mach number (velocity of the cooling air flow) decreases. This decreasing of the Mach number results in a lower through-flow velocity and cooling side internal heat transfer coefficient. This same decreasing Mach number with lower through-flow velocity and cooling side internal heat transfer coefficient also occurs in the airfoil leading edge cooling supply channel 13.

BRIEF SUMMARY OF THE INVENTION

The above described lower internal Mach number and low cooling side internal heat transfer coefficient can be reduced or eliminated by the cooling flow circuit of the present invention in which the cooling air flow for the blade tip cooling circuit is integrated with the main body serpentine flow cooling circuit to form a series cooling circuit in which the cooling air for the main body is then used for the cooling of the blade tip section. The blade cooling circuit includes a three-pass serpentine flow cooling circuit in which the cooling air flows along the suction side wall first toward the trailing edge, then a middle channel toward the leading edge, then a third leg along the pressure side wall toward the trailing edge. Film cooling holes along the periphery of the pressure and suction side channels discharge cooling air from the tip serpentine circuit to provide for cooling along the blade tip periphery.

DETAILED DESCRIPTION OF THE INVENTION

Figure 6:
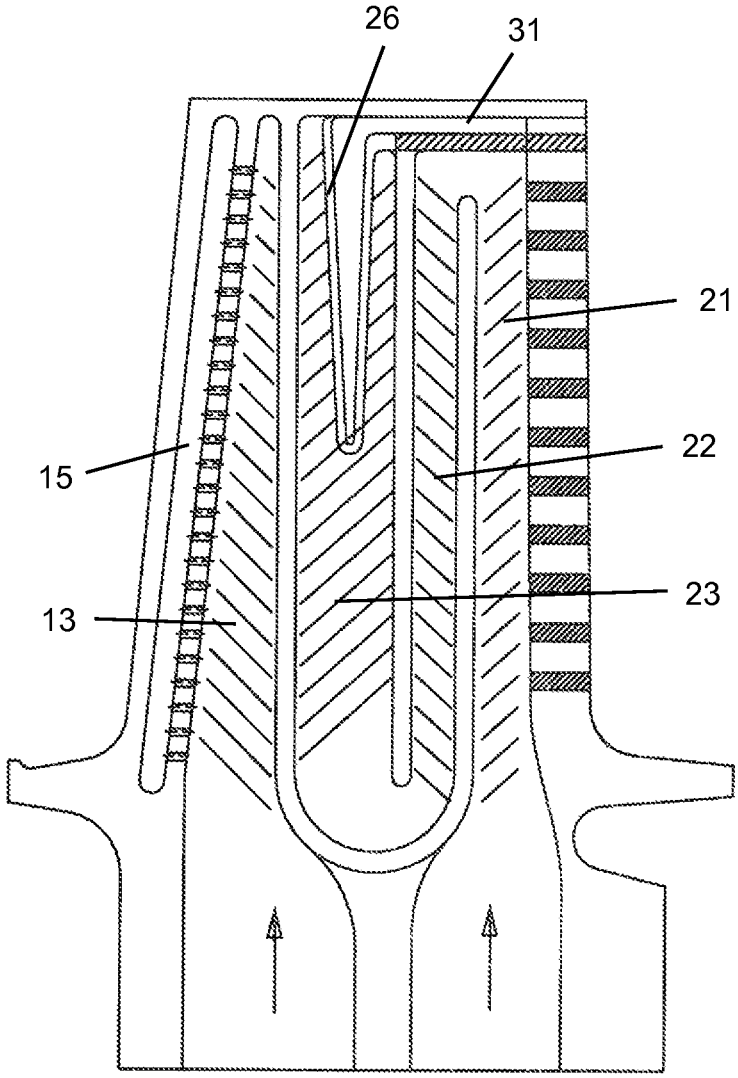
FIG. 6 shows a cross section side view of the blade cooling circuit for the present invention.

The first stage turbine rotor blade of the present invention is shown in FIG. 6 and includes the leading edge cooling air supply channel 13, the row of metering holes that open into the leading edge impingement cavity or channel 15 of the prior art, and the showerhead arrangement of film cooling holes and the P/S and S/S gills holes. The blade also includes a triple pass forward flowing serpentine flow cooling circuit with a first leg 21 located along the trailing edge region of the airfoil, a second leg 22 and a third leg 23 located adjacent to the cooling air supply channel 13. This is contained in the prior art FIG. 1 blade. However, the blade of the present invention includes a tip cooling feed channel insert 26 placed into the upper section of the third or last leg of the forward flowing serpentine circuit of the main body of the airfoil. The purpose of the channel insert 26 is to decrease the cross sectional flow area of that channel so that the cooling air velocity will not decrease below a certain level in which the cooling effectiveness drops. If rows of film cooling holes are used on the pressure side and suction side walls connected to the third leg of the serpentine circuit, the amount of cooling air flowing upward toward the blade tip will decrease and the velocity will drop below a minimum. The channel insert 26 corrects for this.

The channel insert 26 also can have a number of holes that extend along the insert 26 or in the upper end that will allow for the cooling air flowing through the third leg 23 to pass into the channel insert 26 and flow up into the serpentine flow tip cooling circuit described below. In another embodiment, the channel insert 26 can have openings in the upper end that will allow for the cooling air to flow into the insert 26 and up into the tip cooling circuit.

Figure 7:
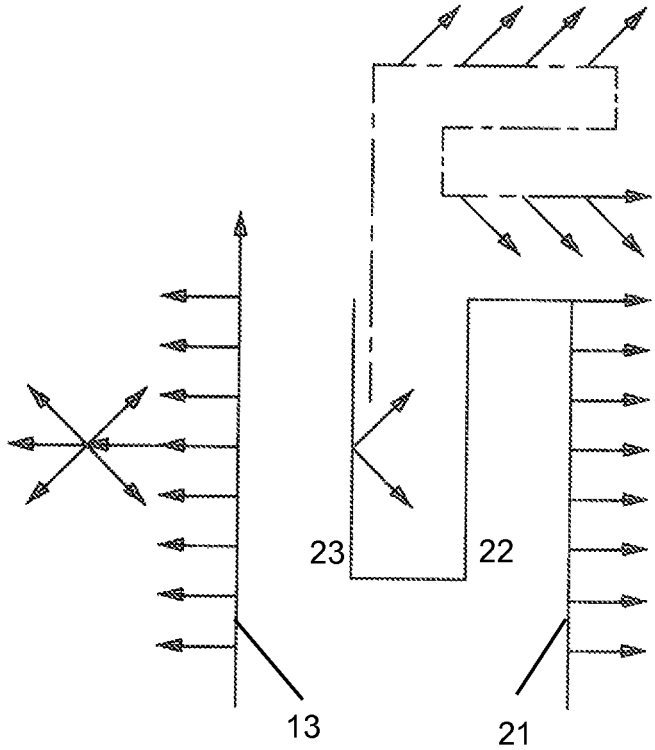
FIG. 7 shows a flow diagram for the blade cooling circuit of FIG. 6.
Figure 9:
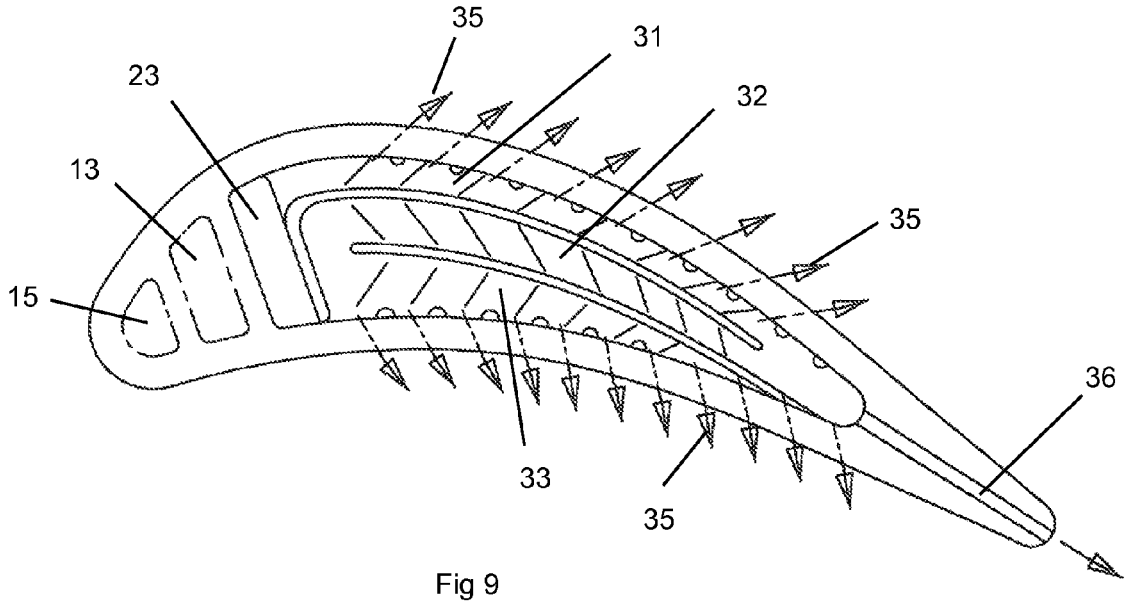
FIG. 9 shows a cross section view of the blade tip triple pass serpentine flow circuit for the FIG. 6 blade.

FIG. 7 shows a flow diagram for the blade cooling circuit with a triple pass serpentine flow circuit formed in the blade tip that receives cooling air from the last leg of the blade main body serpentine flow cooling circuit. Cooling air flows into the first leg of the main serpentine circuit that is positioned along the trailing edge region and supplies some of the cooling air to a row of trailing edge exit slots or holes that extend along the trailing edge of the blade airfoil from the platform to the tip. The cooling air not discharged through the T/E exit slots then flows into the second leg and the third leg where some of the cooling air is discharged through rows of film cooling holes located on the PS wall and/or the S/S wall as a layer of film cooling air. The remaining cooling air from the third and last leg of the main serpentine circuit then flows up and into a first leg of a triple serpentine flow cooling circuit formed in the blade tip. The first leg 31 of the tip serpentine circuit is positioned along the suction side wall of the tip and flows toward the T/E and then turns into a second leg 32 that is formed between the first leg 31 and the third leg 33. The third leg 33 is located along the P/S wall of the tip and flows toward the T/E. As seen in FIG. 9, the first and third legs 31 and 33 are connected to rows of tip film cooling holes 35 that extend along each leg and discharge the film cooling air for the particular side wall of the blade tip. A T/E cooling slot 36 is connected to the turn between the first leg 31 and the second leg 32 to provide cooling for the T/E tip section of the blade. As seen in FIG. 9, the third leg 33 decreases in flow cross sectional area in order to account for the loss of cooling air from the cooling holes positioned along the tip serpentine circuit.

Figure 8:
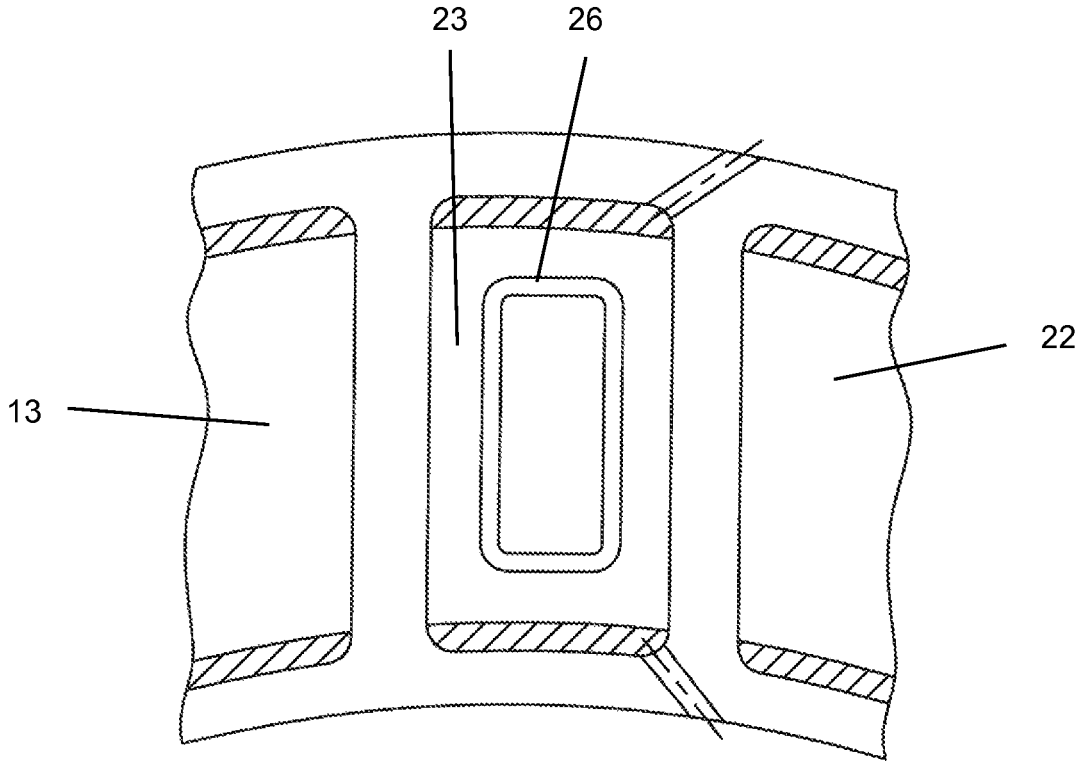
FIG. 8 shows a cross section view of the third leg of the serpentine flow cooling circuit from the FIG. 6 blade.

FIG. 8 shows a cross section view of the third and last leg 23 of the main body serpentine circuit with the channel insert 26 located within the leg 23. Film cooling holes are shown on the P/S and S/S walls that connect to the third leg 23 for discharging layers of film cooling air onto the external surface of the airfoil from the third leg 23. The L/E cooling air supply channel 13 is shown adjacent to the third leg 23 and the second leg 22 is shown adjacent to the third leg 23 opposite from the L/E cooling supply channel 13. Trip strips are used in the cooling flow channels (even in the tip serpentine cooling circuit) to enhance the heat transfer coefficient.

Figure 1:
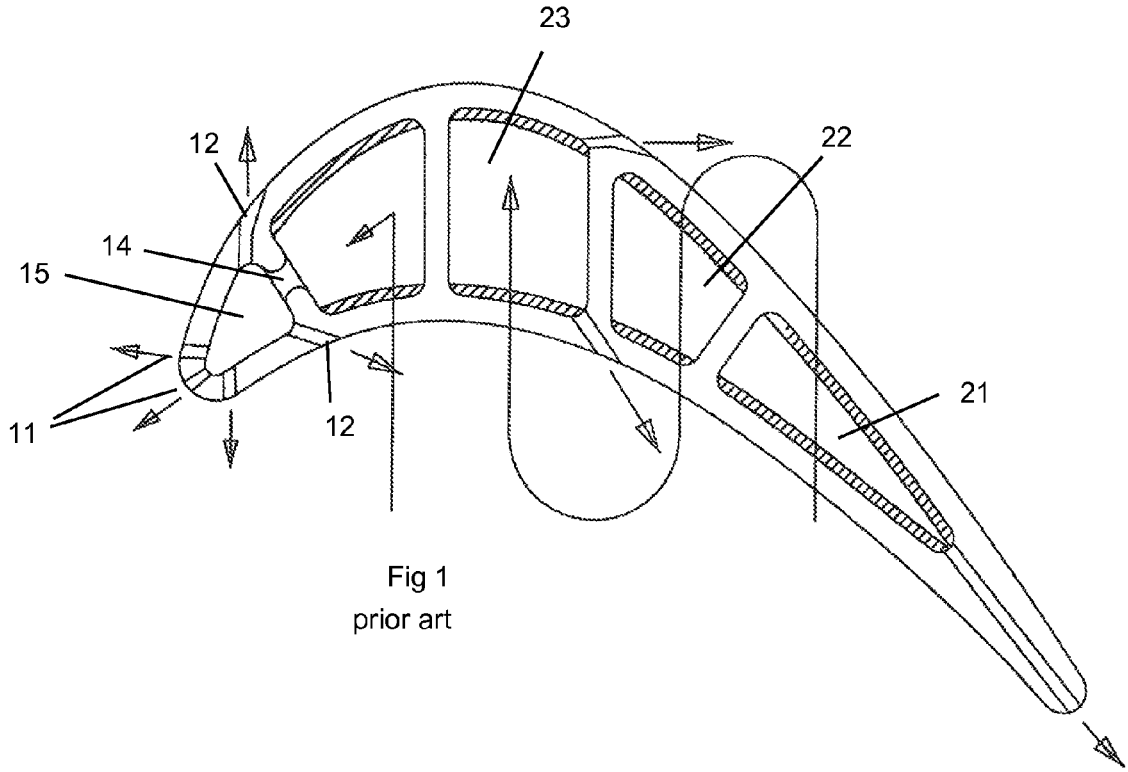
Fig 1 prior art
FIG. 1 shows a cross section view of a prior art turbine rotor blade.
Figure 2:
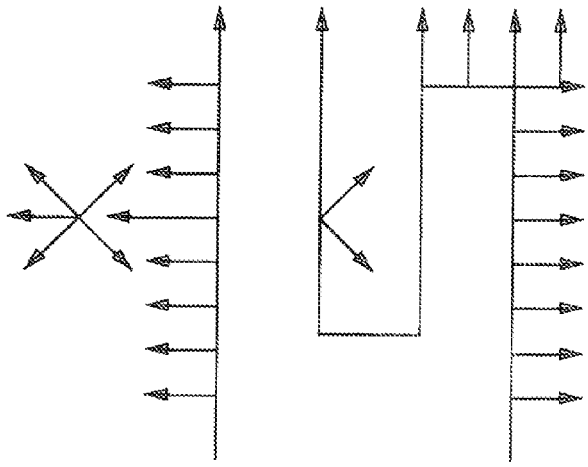
Fig 2 prior art
FIG. 2 shows a flow diagram for the cooling circuit of the blade of FIG. 1.
Figure 3:
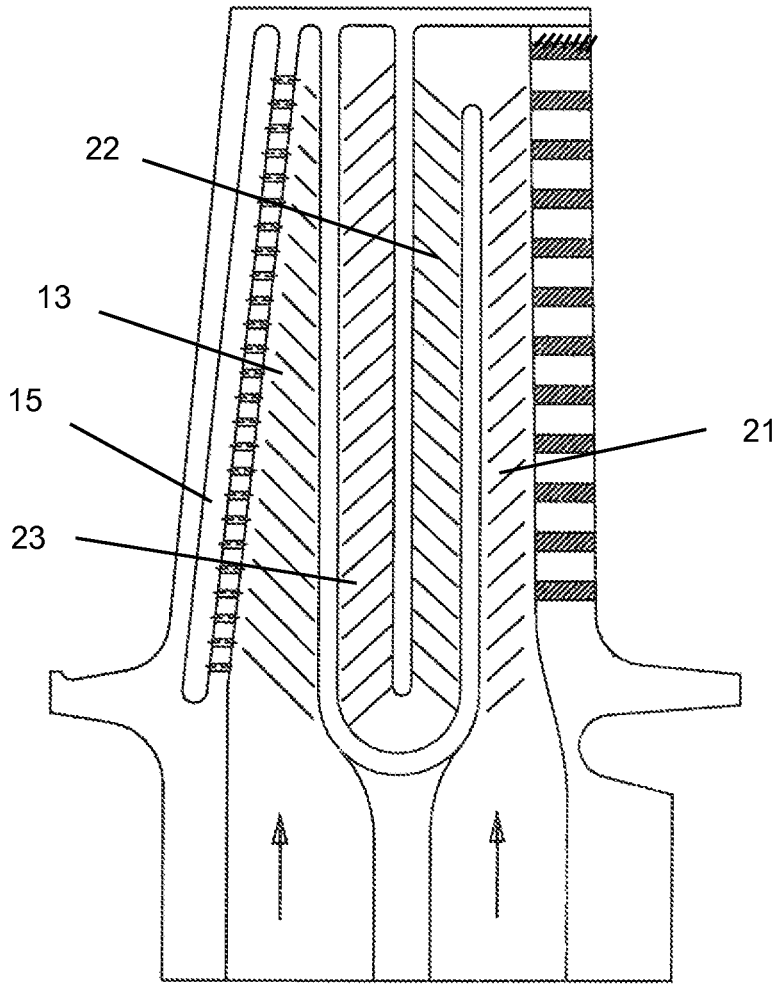
Fig 3 prior art
FIG. 3 shows a cross section side view of the FIG. 1 blade cooling circuit.
Figure 4:
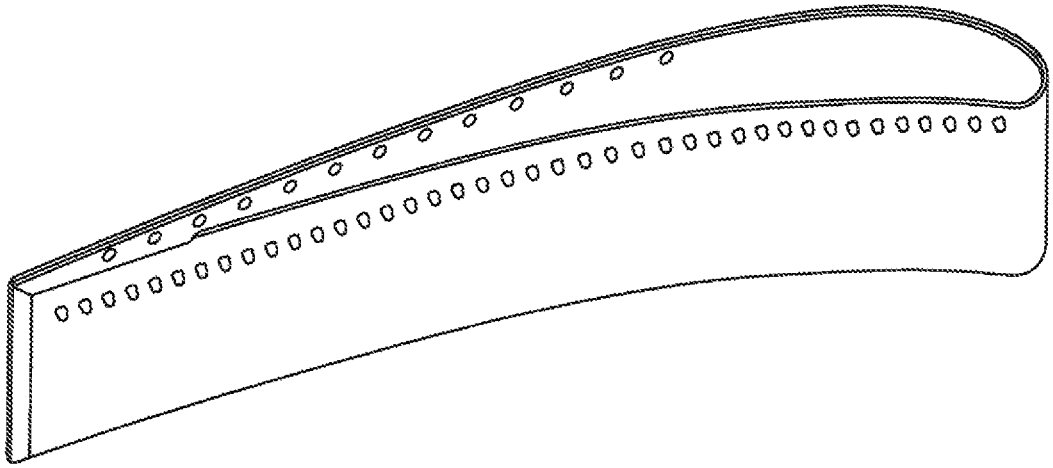
Fig 4 prior art
FIG. 4 shows a schematic view of the pressure side tip periphery film cooling holes for the FIG. 1 blade.
Figure 5:
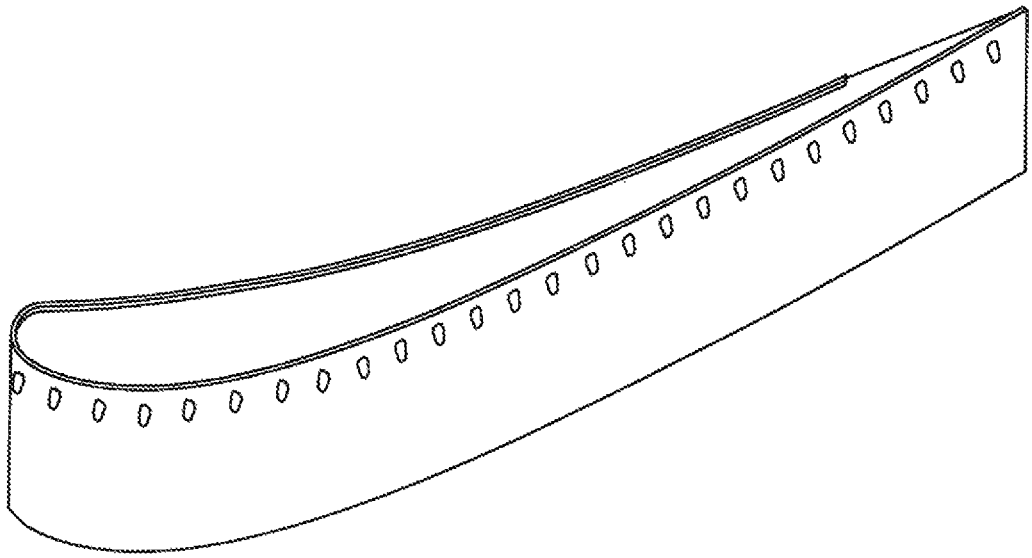
Fig 5 prior art
FIG. 5 shows a schematic view of the suction side tip periphery film cooling holes for the FIG. 1 blade.

For the blade cooling circuit of the prior art FIG. 1, the last leg of the serpentine flow circuit has a geometry predetermined by a ceramic core manufacturing requirement. As a result of the cooling design requirement, when the cooling air is bled off from the cavity for the cooling of both the pressure and suction side walls as well as along the blade tip section, the spanwise internal Mach number decreases below a desired level. This results in a lower through-flow velocity and cooling side internal heat transfer coefficient (to provide high heat transfer rates, a high cooling air velocity is needed).

In operation, a majority of the tip section cooling air has not been discharged from the blade main serpentine flow channel when it reaches the end of the third or last leg of the serpentine flow circuit. As a result of this cooling flow circuit of the present invention, a majority of the tip cooling air is channeled through the airfoil serpentine flow channels to enhance the serpentine flow channel internal through-flow Mach number, resulting in a higher internal heat transfer coefficient and a greatly increased serpentine flow channel internal cooling performance. After the cooling air passes through the main body serpentine flow circuit, the tip section cooling air is then channeled through the blade tip serpentine circuit along the blade tip floor and both rails. Tip section film cooling holes as well as convection cooling holes are drilled into the tip section chordwise serpentine cooling channels (at compound angled orientation) to provide for blade tip section cooling. Since the tip section serpentine cooling channel is running parallel with the blade squealer tip rails, it provides additional backside convection cooling for the blade tip rails. This creates an effective method for the cooling of the blade tip rail and reduces the blade tip rail metal temperature so that erosion of the blade tip does not occur.

I claim the following:

1. A process for cooling a turbine rotor blade for use in an industrial gas turbine engine, the blade having a leading edge region and a trailing edge region, a pressure side wall and a suction side wall extending between the two edges, and a blade tip, the process comprising the steps of:

passing a first cooling air through a serpentine flow path from the trailing edge region toward the leading edge region to provide cooling for the airfoil;

bleeding off a portion of the first cooling air to provide cooling for the trailing edge region of the airfoil;

passing the first cooling air from the serpentine flow path through the blade tip in a serpentine flow path to provide cooling for the blade tip along a suction side tip channel and then along a pressure side tip channel;

discharging some of the cooling air along the suction side tip channel out from the blade to cool the suction side tip edge;

discharging some of the cooling air along the pressure side tip channel out from the blade to cool the pressure side tip edge; and, passing a second and separate cooling air through the leading edge region to provide convection cooling and impingement cooling and film cooling for the leading edge region of the airfoil.

2. The process for cooling a turbine rotor blade of claim 1, and further comprising the step of:

discharging a portion of the first cooling air toward an end of the airfoil serpentine flow path as a layer of film cooling air onto the pressure side wall or the suction side wall of the airfoil.

3. The process for cooling a turbine rotor blade of claim 1, and further comprising the step of:

decreasing a cross sectional flow area of the first cooling air toward an end of the airfoil serpentine flow path so that a Mach number of the cooling air does not decrease below a desired level.

4. A turbine rotor blade comprising:

an airfoil extending from a platform;

the airfoil having a leading edge region and a trailing edge region with a pressure side wall and a suction side wall extending between the two edges;

a multiple pass serpentine flow cooling circuit formed within the airfoil with a first leg located adjacent to the trailing edge region and a last leg located in a forward region of the airfoil;

a multiple pass serpentine flow cooling circuit formed within a blade tip section of the airfoil;

the blade tip serpentine flow cooling circuit having a first leg located along one of the two side walls of the blade tip and connected to the last leg of the airfoil serpentine flow cooling circuit and a last leg located along the other of the two side walls of the blade tip; and, the first and last legs of the blade tip serpentine flow cooling circuit both being connected to tip cooling holes to provide cooling for the pressure side tip region and the suction side tip region.

5. The turbine rotor blade of claim 4, and further comprising:

the airfoil serpentine flow cooling circuit is a triple pass serpentine circuit.

6. The turbine rotor blade of claim 4, and further comprising:

the airfoil serpentine flow cooling circuit extends from a platform of the blade to the blade tip.

7. The turbine rotor blade of claim 4, and further comprising:

the last leg of the airfoil serpentine flow cooling circuit includes a channel insert to decrease a cross sectional flow area such that a velocity of the cooling air flow remains above a desired value; and, the channel insert includes a passage for cooling air to flow from the last leg of the airfoil serpentine circuit into the first leg of the blade tip serpentine flow cooling circuit.

8. The turbine rotor blade of claim 7, and further comprising:

the last leg of the airfoil serpentine flow cooling circuit is connected to a row of film cooling holes located on the pressure side wall or the suction side wall of the airfoil.

9. The turbine rotor blade of claim 4, and further comprising:

a row of exit slots located along the trailing edge region of the airfoil and connected to the first leg of the airfoil serpentine flow cooling circuit.

10. The turbine rotor blade of claim 4, and further comprising:

the first leg of the blade tip serpentine flow cooling circuit is located along the suction side wall of the blade tip; and, the last leg of the blade tip serpentine flow cooling circuit is located along the pressure side wall of the blade tip.

11. The turbine rotor blade of claim 4, and further comprising:

the last leg of the blade tip serpentine flow cooling circuit has a decreasing cross sectional flow area.

12. A turbine rotor blade comprising:

an airfoil with a pressure side wall and a suction side wall both extending between a leading edge region and a trailing edge region;

a row of exit holes in the trailing edge region of the airfoil;

a forward flowing serpentine flow cooling circuit formed within the airfoil and having a first leg located adjacent to the exit holes to supply cooling air to the exit holes;

a last leg of the serpentine flow cooling circuit discharging into a blade tip serpentine flow cooling circuit;

the blade tip serpentine flow cooling circuit having a first leg extending along a suction side of the blade tip and a last leg extending along a pressure side of the blade tip;

both the first leg and the last leg of the blade tip serpentine flow cooling circuit flowing toward the trailing edge; and, both the first leg and the last leg of the blade tip serpentine flow cooling circuit having a row of tip cooling holes to discharge cooling air onto a wall of the airfoil at the blade tip.

13. The turbine rotor blade of claim 12, and further comprising:

the last leg of the airfoil serpentine flow cooling circuit includes an insert shaped to decrease a cross sectional flow area in a direction toward the blade tip; and, the last leg of the airfoil serpentine flow cooling circuit is connected to a row of film cooling holes on either the pressure side wall or the suction side wall.

14. The turbine rotor blade of claim 12, and further comprising:

the blade tip serpentine flow cooling circuit is a three-pass serpentine circuit with a second leg located between the first and third legs; and, each of the three legs flows in a chordwise direction of the blade tip.

* * * * *